United States Patent [19]

Brain et al.

[11] 4,145,184

[45] Mar. 20, 1979

[54] DETERGENT COMPOSITION CONTAINING ENCAPSULATED PERFUME

[75] Inventors: Devin K. Brain; Marian T. Cummins, both of Cincinnati, Ohio

[73] Assignee: The Procter & Gamble Company, Cincinnati, Ohio

[21] Appl. No.: 636,381

[22] Filed: Nov. 28, 1975

[51] Int. Cl.[2] ..... B08B 3/04; B08B 3/10

[52] U.S. Cl. ..... 8/137; 252/90; 252/132; 252/134; 252/174; 252/316; 252/522; 428/307; 428/905

[58] Field of Search ..... 252/316, 8.8, DIG. 14, 252/132, 522, 90, 134, 174; 8/137; 428/905, 307

[56] References Cited

U.S. PATENT DOCUMENTS

| | | | |
|---|---|---|---|
| 3,091,567 | 5/1963 | Wurzburg et al. | 167/42 |
| 3,137,631 | 6/1964 | Soloway | 424/16 X |
| 3,516,941 | 6/1970 | Matson | 252/316 |
| 3,632,296 | 1/1972 | Pandell et al. | 252/316 |
| 3,798,179 | 3/1974 | Hellyer | 252/316 X |
| 3,870,542 | 3/1975 | Ida | 117/33.3 |
| 3,914,185 | 10/1975 | Inamorato | 252/DIG. 14 X |

*Primary Examiner*—Benjamin R. Padgett
*Assistant Examiner*—E. Suzanne Parr
*Attorney, Agent, or Firm*—Steven J. Goldstein; Robert B. Aylor; Richard C. Witte

[57] ABSTRACT

A detergent composition contains perfume in the form of water-insoluble, friable microcapsules which become entrained in or on fabric during a laundering process and which release the perfume during manipulation of the dry fabric.

19 Claims, No Drawings

DETERGENT COMPOSITION CONTAINING ENCAPSULATED PERFUME

BACKGROUND OF THE INVENTION

The present invention relates to detergent compositions and, in particular, to compositions including a perfuming agent which becomes associated with fabrics being laundered and which remains intact on the fabrics throughout the laundering operation. Manipulation of the fabric after laundering then causes release of perfume from the perfuming agent.

While the primary purpose of a detergent composition is to clean fabrics being laundered, there are various other desirable benefits which can be imparted to the fabrics during laundering. One such benefit is to render the laundered fabric more aesthetically pleasing, in particular by perfuming the fabric in such a way that the user is aware of this added aesthetic appeal.

Delivery of perfume to a fabric during the laundering operation is not easy, because by their nature perfumes are volatile substances and they tend to volatilize or disperse during washing in relatively hot water. A further difficulty is caused by the widespread use of gas or electric laundry dryers in which the laundered fabrics are tumbled at a relatively high temperature. Even perfumes which have a degree of substantivity for the fabrics will volatilize to a large extent in the dryer with the result that the finished laundered fabric has only a very faint odor which rapidly dissipates.

Attempts have been made to achieve a more controlled release of perfume during the laundering operation. For example, U.S. Pat. No. 3,091,567 relates to perfume materials which are encapsulated so that the perfume is released slowly in the presence of moisture and this patent suggests that these perfumes may be incorporated into detergents. British Patent 1,313,697 and German Specification 2,408,636 both relate to perfumes which are incorporated into a carrier material for addition to an automatic clothes dryer so that perfume is distributed over the fabrics being dried. Copending U.S. Pat. application Ser. No. 516,052, now abandoned, relates to the adsorption of the perfume onto insoluble starch particles for fabric treatment in a clothes dryer. Copending U.S. Pat. application Ser. No. 586,448, now abandoned, relates to microencapsulated perfumes in combination with a transfer agent for use in a clothes dryer and U.S. Pat. application Ser. No. 595,638, now abandoned relates to combinations of perfume with a fabric substantive material to provide improved odor deposition onto fabrics.

All of the above developments, while offering some advantage in perfume deposition onto fabrics, do require an extra process in the laundering operation, namely that of adding a perfume material at the drying stage. Furthermore, even with these improved methods, a substantial amount of perfume can still be lost during the drying process.

Accordingly, it is an object of the present invention to provide an improved method for delivering perfume to fabrics wherein the perfuming agent is employed in the washing stage of the laundering process.

It is a further object of the present invention to provide a detergent composition which includes a perfuming agent which can deliver effective amounts of a perfume to completely laundered fabrics.

It has surprisingly been discovered that particular types of water-insoluble perfume-containing microcapsules can be employed in conjunction with conventional detergent compositions in order to achieve the above objectives. Although treatment of fabrics with microcapsules is known (see, for example, U.S. Pat. Nos. 3,870,542, 3,632,296, 3,137,631, and 3,401,123), the prior art has not suggested that microcapsules can be employed in conjunction with detergents to provide a fabric benefit.

SUMMARY OF THE INVENTION

According to the invention, there is provided a laundry detergent composition comprising (a) from 2% to 95% of a surfactant selected from the the group consisting of anionic, nonionic, ampholytic and zwitterionic surfactants; and (b) an effective amount of a perfuming agent comprising a perfume encapsulated in a water-insoluble, friable microcapsule.

In a method aspect of the invention, a fabric treatment process comprises washing fabrics in the above detergent composition whereby at least a portion of the microcapsules become entrained in the fabric, drying the fabric and manipulating the fabric so as to rupture at least a portion of the microcapsules to release the perfume.

The microcapsules utilized in the invention comprise a core of perfume material, usually liquid, and a thin polymeric shell surrounding the core. The microcapsules can vary in size from 5 microns to about 300 microns and generally have a shell thickness of between about 0.1 to 50 microns.

The detergent composition can additionally contain other conventional ingredients, especially builders, and can be in any form, for example granular, paste, or liquid.

DETAILED DESCRIPTION OF THE INVENTION

The present invention involves the laundering of fabrics using a detergent composition which contains friable microcapsules of perfume followed by manipulation of the laundered fabrics so as to rupture the microcapsules. The microcapsules are therefore applied to the fabrics at the washing stage of the laundering process. Each of these aspects of the present invention as well as compositions suitable for carrying out the method of the present invention are discussed in detail as follows:

Microcapsules

The microcapsules useful in the present invention comprise a liquid core containing one or more perfume ingredients and a thin polymeric shell completely surrounding the liquid core. By encapsulating the perfume in a water-insoluble shell, the perfume is protected throughout the laundering operation. Surprisingly, it has been found that a significant number of the microcapsules are entrained in or otherwise become associated with the fabric during the washing process and remain intact through the remainder of the laundry operation. The perfume is actually applied to the fabrics only when the microcapsules rupture. This can occur to some extent during the automatic drying step of the home laundering operation but principally occurs after the fabrics are laundered and while they are being used.

In the context of this specification, the term "perfume" means any odoriferous material or any material which acts as a malodor counteractant. In general, such materials are characterized by a vapor pressure above atmospheric pressure at ambient temperatures. The perfume or deodorant materials employed herein will most often be liquid at ambient temperatures, but also can be solids such as the various camphoraceous perfumes known in the art. A wide variety of chemicals are known for perfumery uses, including materials such as aldehydes, ketones, esters, and the like. More commonly, naturally-occurring plant and animal oils and exudates comprising complex mixtures of various chemical components are known for use as perfumes, and such materials can be used herein. The perfumes herein can be relatively simple in their composition, or can comprise highly sophisticated, complex mixtures of natural and synthetic chemical components, all chosen to provide any desired odor.

Typical perfumes herein can comprise, for example, woody/earthy bases containing exotic materials such as sandalwood oil, civet, patchouli oil, and the like. The perfumes herein can be of a light, floral fragrance, e.g., rose extract, violet extract, and the like. The perfumes herein can be formulated to provide desirable fruity odors, e.g., lime, lemon, orange, and the like. In short, any material which exudes a pleasant or otherwise desirable odor can be used in the liquid microcapsule core to provide a desirable odor when applied to fabrics.

Perfumes which are normally solid can also be employed in the microcapsule core, and these may be admixed with a liquefying agent such as a solvent.

The invention also encompasses the use of materials which act as malodor counteractants. These materials, although termed "perfumes" hereinafter, may not themselves have a discernible odor but can conceal or reduce any unpleasant odors which may occur, for example, when fabrics are worn for prolonged periods of time. Examples of suitable malodor counteractants are disclosed in U.S. Pat. No. 3,102,101, issued Aug. 27, 1963 to Hawley et al.

The shell material surrounding the perfume core to form the microcapsule can be any suitable polymeric material which is impervious to the materials in the liquid core and the materials which may come in contact with the outer surface of the shell. The microcapsule shell wall can be composed of a wide variety of polymeric materials including polyurethane, polyolefin, polyamide, polyester, polysaccharide, silicone resins, and epoxy resins. Many of these types of polymeric microcapsule shell materials are further described and exemplified in Ida et al, U.S. Pat. No. 3,870,542, issued Mar. 11, 1975, the disclosure of which is incorporated herein by reference.

Highly preferred materials for the microcapsule shell wall are the aminoplast polymers comprising the reactive products of urea and aldehyde, e.g. formaldehyde. Such materials are those which are capable of acid condition polymerization from a water-soluble prepolymer state. Such prepolymers are made by reacting urea and formaldehyde in a formaldehyde:urea molar ratio of from about 1.2:1 to 2.6:1. Thiourea, cyanuramide, guanidine, N-alkyl ureas, phenols, sulfonamides, anilines and amines can be included in small amounts as modifiers for the urea. Polymers formed from such prepolymer materials under acid conditions are water-insoluble and can provide the requisite capsule friability characteristics as described more fully hereinafter.

Microcapsules having the liquid cores and polymer shell walls as described above can be prepared by any conventional process which produces capsules of the requisite size, friability and water-insolubility. Generally, such methods as coacervation and interfacial polymerization can be employed in known manner to produce microcapsules of the desired characteristics. Such methods are described in Ida et al, U.S. Pat. No. 3,870,542, issued Mar. 11, 1975; Powell et al, U.S. Pat. No. 3,415,758, issued Dec. 10, 1968; and Anthony, U.S. Pat. No. 3,041,288, issued June 26, 1962. All of these patents are incorporated herein by reference.

Microcapsules made from the preferred urea-formaldehyde shell materials can be made by an interfacial polymerization process described more fully in Matson, U.S. Pat. No. 3,516,941, issued June 23, 1970, incorporated herein by reference. By that process an aqueous solution of a urea-formaldehyde precondensate (methylol urea) is formed containing from about 3% to 30% by weight of the precondensate. Water-insoluble liquid core material (i.e., perfume) is dispersed throughout this solution in the form of microscopically-sized discrete droplets. While maintaining solution temperature between 20° C. and 90° C., acid is then added to catalyze polymerization of the dissolved urea-aldehyde performance. If the solution is rapidly agitated during this polymerization step, shells of water-insoluble urea-formaldehyde polymer form around and encapsulate the dispersed droplets of liquid core material. Preferred microcapsules for use in the present invention are thereby produced.

No matter how the microcapsules utilized herein are produced, it is essential that the microcapsules vary in size (i.e., maximum diameter between about 5 microns and about 300 microns, preferably between about 10 microns and about 200 microns. As the capsule particle size approaches 300 microns, e.g. 250 microns), a reduction in the number of capsules entrained in the fabric is observed. Fabrics treated with capsules of a size greater than 300 microns, e.g. 400 and 500 microns, do not give a discernible odor when rubbed. Furthermore, the capsules utilized in the present invention generally have an average shell thickness ranging from about 0.1 micron to 50 microns, preferably from about 1 micron to about 10 microns. Normally, capsules having a perfume loading of from about 50% to about 85% by weight of the capsule will be employed.

The microcapsules of the present invention must also be friable in nature. Friability refers to the propensity of the microcapsules to rupture or break open when subjected to direct external pressures or shear forces. For purposes of the present invention, the microcapsules utilized are "friable" if, while attached to fabrics treated therewith, they can be ruptured by the forces encountered when the capsule-containing fabrics are manipulated by being worn or handled.

The detergent compositions of the invention can comprise any effective amount of the friable microcapsules. By "effective amount" is meant an amount of microcapsules sufficient that the number becoming attached to the fabric during the laundering operation is enough to impart a noticeable odor to the laundered fabric when the fabric is rubbed or scratched.

The microcapsules vary in their degree of attachment depending on the fabric used, although there is some attachment on all fabrics. Fabrics such as smooth cotton fabrics and nylon tend to show a relatively low degree of attachment and correspondingly more capsules are necessary in the composition. Knit Dacron polyester fabric shows a high degree of attachment and therefore fewer capsules can be employed.

Another factor which influences to some extent the deposition of the perfume microcapsules on to fabric is the surface appearance of the capsules. Depending on the processing of the capsules, their outer surface may be relatively smooth or relatively rough. For example, it has been found that capsules made by the process of U.S. Pat. No. 3,516,941 tend to have surface protuberances. Those capsules which have such protuberances tend to become more effectively entrained in fabric.

While not intending to be limited by theory, this result does suggest that the mechanism of capsule deposition depends at least to some extent on physical entrapment of the capsules in the fabric. The high mechanical agitation experienced by the fabrics during a wash cycle tends to encourage frequent and rigorous contact between the capsule and the fabric, whereby the capsules become entrained in the fabric.

Generally speaking, the detergent composition of the invention will use from 0.05% to about 5% by weight of the composition of microcapsules, preferably from 0.1% to 1%.

Fabric Manipulation

Once microcapsules containing fabric conditioning agent have been attached to fabrics being treated, it is, of course, necessary to manipulate the treated fabrics in a manner sufficient to rupture the microcapsules and thereby release the conditioning agent. Microcapsules of the type utilized herein have friability characteristics such that the ordinary fabric manipulation which occurs when the treated fabrics are worn or used is sufficient for the attached microcapsules to impart a noticeable odor to the fabric. A significant number of attached microcapsules can be broken by the normal forces encountered when treated garments are worn. For fabric articles which are not worn, the normal household handling operations such as folding, crumpling etc. can serve as fabric manipulation sufficient to rupture the attached microcapsules.

Surfactant

Detergent compositions of the invention comprise from about 2% to 95% by weight of a surfactant selected from anionic, nonionic, ampholytic, and zwitterionic surfactants. Such compositions preferably contain from about 10% to 60% by weight of surfactant. Surfactant levels tend to be relatively high, from 20% to 50%, in liquid compositions and relatively low, from 10% to 25% in granular compositions. Pasty or gel-like compositions may have very much higher surfactant concentrations, for example, from 45% to 95%. Liquid compositions which are designed for use without dilution may have from 2% to 10% of surfactant.

Water-soluble surfactants used in the presoaking-/washing compositions herein include any of the common anionic, nonionic, ampholytic and zwitterionic detersive surfactants well known in the detergency arts. Mixtures of surfactants can also be employed herein. More particularly, the surfactants listed in Booth, U.S. Pat. No. 3,717,630, issued Feb. 20, 1973 and Kessler et al, U.S. Pat. No. 3,332,880, issued July 25, 1967, each incorporated herein by reference, can be used herein. Non-limiting examples of surfactants suitable for use in the instant compositions are as follows:

Water-soluble salts of the higher fatty acids, i.e., "soaps" are useful as the anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present presoaking/washing compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol polyethylene oxide ether sulfate containing about 1 to about 10 units of ethylene oxide per molecule and wherein the alkyl groups contain about 8 to about 12 carbon atoms.

The alkaline earth metal salts of synthetic anionic surfactants are useful in the present invention. In particular, the magnesium salts of linear alkylbenzene sulfonates, in which the alkyl group contains from 9 to about 15, especially 11 to 12, carbon atoms, are useful.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic suractants herein include linear alkyl benzene sulfonates containing from about 11 to 14 carbon atoms in the alkyl group; the tallow range alkyl sulfates; the coconut range alkyl glyceryl sulfonates; and alkyl ether sulfates wherein the alkyl moiety contains from about 14 to 18 carbon atoms and wherein the average degree of ethoxylation varies between 1 and 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures.

Nonionic surfactants include the water-soluble polyethoxylates of $C_{10}$–$C_{20}$ aliphatic alcohols and $C_6$–$C_{12}$ alkyl phenols. Many nonionic surfactants are especially suitable for use as suds controlling agents in combination with anionic surfactants of the type disclosed herein.

Nonionic surfactants may also be of the semi-polar type including water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium, and sulfonium compounds in which the aliphatic moieties can be straight or branched chain, and wherein one of the aliphatic substituents contains from about 8 to 18 carbon atoms and one contains an anionic water-solubilizing group. Other useful zwitterionic materials are the ethoxylated ammonium sulfonates and sulfates disclosed in U.S. Pat. No. 3,929,678, issued Dec. 30, 1975 and incorporated herein by reference.

Builder Salts

The compositions of the present invention can also comprise those detergency builders commonly taught for use in laundry compositions. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, bicarbonates, borates, and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,522,137; 3,400,176; and 3,400,148, incorporated herein by reference. Sodium tripolyphosphate is an especially preferred, water-soluble inorganic builder herein.

Non-phosphorus containing sequestrants can also be selected for use herein as detergency builders. Specific examples of non-phosphorus, inorganic builder ingredients include water-soluble inorganic carbonate, bicarbonate, borate, and silicate salts. The alkali metal, e.g., sodium and potassium, carbonates, bicarbonates, borates (Borax), and silicates are particularly useful herein.

Water-soluble, organic builders are also useful herein. For example, the alkali metal, ammonium and substituted ammonium polyacetates, carboxylates, polycarboxylates, succinates, and polyhydroxysulfonates are useful builders in the present compositions and processes. Specific examples of the polyacetate and polycarboxylate builder salts include sodium, potassium, lithium, ammonium, and substituted ammonium salts of ethylene diamine tetraacetic acid, nitrilotriacetic acid, oxydisuccinic acid, mellitic acid, benzene polycarboxylic acids, and citric acid.

Highly preferred non-phosphorus builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in the abandoned Application of Benjamin, Ser. No. 248,546, filed Apr. 28, 1972, the disclosure of which is incorporated herein by reference.

Specific examples of materials capable of forming the water-insoluble reaction product include the water-soluble salts of carbonates, bicarbonates, sesquicarbonates, silicates, aluminates, and oxalates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, inventor Bauman, issued Jan. 28, 1969, incorporated herein by reference.

The complex aluminosilicates, i.e., zeolite-type materials, are useful presoaking/washing adjuvants herein in that these materials soften water, i.e., remove $Ca^{++}$ hardness. Both the naturally occurring and synthetic "zeolites," especially zeolite A and hydrated zeolite A materials, are useful for this builder/softener purpose. A description of zeolite materials and a method of preparation appears in Milton, U.S. Pat. No. 2,882,243, issued Apr. 14, 1959, incorporated herein by reference. The copending application of Corkill et al., entitled DETERGENT COMPOSITION, Ser. No. 450,266, filed Mar. 11, 1974, describes the use of hydrated synthetic zeolites as builders and is also incorporated herein by reference.

The detergent builders are used at concentrations of from about 10% to about 80%, preferably 20% to 50% by weight of the detergent compositions.

Other Components

In addition to the above-described surfactant or builder components, the present granular compositions can optionally contain a wide variety of other conventional detergency adjuncts. Representative materials of this type include, for example, the various anticaking agents, filler materials, optical brighteners, anti-spotting agents, dyes, and the like. These adjunct materials are commonly used as minor components (e.g., 0.1% to 5% wt.) in compositions of the present type. The compositions can also include perfumes additional to the microencapsulated perfume so that the composition itself or the wash solution has a pleasant odor.

Highly preferred optional additives herein include various bleaches commonly employed in presoak, laundry additive and detergent compositions. Such bleaches can include, for example, the various organic peroxyacids such as peradipic acid, perphthalic acid, diperphthalic acid, diperazelaic acid and the like. Inorganic bleaches, i.e. persalts including such materials as sodium perborate, sodium perborate tetrahydrate, urea peroxide, and the like, can be employed in the compositions herein. Bleaches are commonly used in the instant granular compositions at a level of from about 1% to about 45% by weight.

An especially preferred bleaching agent for use herein is sodium perborate tetrahydrate, at an effective concentration of from about 10% to about 30% by weight of the total composition.

Liquid or pasty compositions, in particular, can include materials to impart alkalinity to the detergent solution; typical of such materials are mono-, di- and tri-ethanolamine.

Various detergency enzymes well known in the art for their ability to degrade and aid in the removal of various soils and stains can also be employed in the present granular compositions. Detergency enzymes are commonly used at concentrations of from about 0.1% to about 1.0% by weight of such compositions. Typical enzymes include the various proteases, lipases, amylases, and mixtures thereof, which are designed to remove a variety of soils and stains from fabrics.

Composition Preparation

Compositions of the present invention can be prepared in any wide variety of product forms, for example, as granules, powders, liquids, gels, pastes, or tablets. Where a solid product form is desired, a granular composition is generally preferred and a slurry comprising a builder salt such as sodium tripolyphosphate and a surfactant system can be spray-dried to form granules. Alternatively, the product may be agglomerated, and this is preferred with certain nonionic surfactants which are relatively low boiling and may degrade during spray-drying. Whichever method is adopted to prepare the granular composition, the perfume microcapsules of the present invention are normally admixed after the formation of the detergent granules and, surprisingly, it has been found that the microcapsules have little or no tendency to segregate from the remainder of the solid compositions.

The composition may also be prepared in liquid form and, in this case, the surfactant and other ingredients are normally dissolved or dispersed in water or a water-alcohol mixture, preferred alcohols being $C_1$–$C_3$ alkanols, especially ethanol. In liquid compositions, it is of course important that the microcapsules are insoluble in the liquid phase and it is also essential that they remain evenly dispersed throughout the liquid composition. To achieve this homogeneous dispersion, materials may be added to the liquid formulations to thicken the liquid or render it thixotropic so that the microcapsules remain suspended therein. Suitable thickening agents include, for example, cellulose derivatives such as methylcellulose, and colloidal silica materials.

Performance Testing

Perfume microcapsules were prepared using the process of U.S. Pat. No. 3,516,941, of Matson. The perfumes used were of the type which is conventional in detergent compositions and the capsules (0.3 wt. %) were then mixed into an unperfumed granular laundry detergent composition containing 21% of anionic surfactant (linear $C_{12}$ alkylbenzene sulfonate), 25% of sodium tripolyphosphate, 12% of sodium silicate ($SiO_2$/$Na_2O$ ratio 2.0) and 16% of sodium sulfate.

Microcapsules of varying sizes were employed and the compositions were evaluated in the following manner:

Fabrics of three different types, cotton terry cloth, knit Dacron polyester and nylon were washed in an automatic washing machine in the compositions of the invention, rinsed and dried in an automatic clothes dryer. The clothes were then graded by the panel of judges to determine their odor impact before and after rubbing. A nine-point grading scale was used; in approximate terms, grades 1–3 indicate little or no odor impact, grades 4–6 represent noticeable odor impact and grades 7–9 represent strong odor impact. For example, a grading of 2/8 indicates that the cloth before rubbing had only a very slight odor (2), but after rubbing had a pronounced odor (8).

The effect of capsule size is indicated in Table 1. It will be appreciated that the capsules used in each composition demonstrate a relatively large size distribution and the nominal particle size stated represents an average particle size. For example, the capsules with an average size of 115 microns below had a size distribution from 60–150 microns. In Table 1, the capsules had a loading of 60% perfume.

TABLE 1

EFFECT OF CAPSULE SIZE ON PERFUME GRADES (60% PERFUME)

| AVERAGE CAPSULE SIZE (μ) | ODOR GRADES (Before/after rubbing) Terry Cloth | Dacron | Nylon |
|---|---|---|---|
| 14 | 3/6 | 3.5/7 | 3.5/7 |
| 22 | 3/4 | 3.5/4.5 | 3/5 |
| 29 | 3/8 | 3/7 | 2/2 |
| 34 | 3/4 | 3.5/5 | 2/3.5 |
| 61 | 4/7 | 3/8 | 2/2 |
| 75 | 3/8 | 3/8 | 2/4 |
| 200 | 4/8 | 6/7.5 | 3/7 |

Table 2 also shows the effect of varying capsule size, in this case using capsules which have an 81% perfume payload.

TABLE 2

EFFECT OF PARTICLE SIZE ON PERFUME GRADES (81% PERFUME)

| AVERAGE CAPSULE SIZE (μ) | ODOR GRADES Terry Cloth | Dacron | Nylon |
|---|---|---|---|
| 23 | 4/5.5 | 2/6 | 2/5 |
| 32 | 3/5 | 3/5 | 3/5.5 |
| 56 | 4/6 | 3/8 | 3/7 |
| 75 | 4/7 | 3/9 | 3/6 |
| 115 | 3.5/4.5 | 3/5 | 3/3.5 |

TABLE 2-continued

| EFFECT OF PARTICLE SIZE ON PERFUME GRADES (81% PERFUME) | | | |
|---|---|---|---|
| AVERAGE | ODOR GRADES | | |
| CAPSULE SIZE (μ) | Terry Cloth | Dacron | Nylon |
| 180 | 3/4 | 2/7 | 2/4 |

As can be seen from Tables 1 and 2, beneficial results are obtained over a wide range of capsule size and with differing perfume loading. Substantially similar results were obtained when the test cloths were line-dried instead of being dried in an automatic dryer.

A commercially-used perfume, namely that used in Gain, a laundry detergent marketed by The Procter & Gamble Company was encapsulated in the manner indicated above. The capsules were then added at a 0.6% level to four different commercial laundry detergents, all marketed by The Procter & Gamble Company. Table 3 shows the results obtained following the above-described test procedure.

TABLE 3

| EFFECT OF DIFFERENT DETERGENTS | | | |
|---|---|---|---|
| | ODOR GRADES | | |
| DETERGENT | TERRY CLOTH | DACRON | NYLON |
| GAIN | 4/8 | 2/9 | 2/6 |
| TIDE | 2/7.5 | 5/8 | 3/5 |
| DASH | 3/7 | 3/9 | 2/5 |
| CHEER | 3/6.5 | 4.5/7.5 | 3/5 |

The capsules used in the compositions of Table 3, having an average particle size of 32μ and a perfume loading of 75% can be employed in each of the following examples which are illustrative of the present invention.

EXAMPLE I

Spray-dried laundry detergent compositions having the following formula are useful in the present invention. In each case, the perfume microcapsules are admixed after the basic detergent granule is spray-dried

| Ingredient | Composition (wt. %) A | B |
|---|---|---|
| Sodium alkylbenzene sulfonate | 7 | 12 |
| Tallow alcohol sulfate | 6 | |
| $C_{14}$ alcohol ethoxylate sulfate | 6 | 8 |
| Sodium tripolyphosphate | 24 | 25 |
| Sodium silicate (2.0r) solids | 5 | 12 |
| Sodium carbonate | 6 | |
| Sodium sulfate | 17 | 33 |
| Zeolite* | 18 | |
| Perfume microcapsules | 0.6 | 0.6 |
| Moisture and miscellaneous | to 100 | to 100 |

*Synthetic Zeolite as described in U.S. Patent Application of Corkill, Serial No. 450,266, filed March 11, 1974.

EXAMPLE II

Granular nonionic detergent compositions according to the invention have the following formula:

| Ingredient | Composition (wt. %) A | B |
|---|---|---|
| A condensate of 7 moles of ethylene oxide with 1 mole of $C_{14-15}$ alkanol | 18 | 11 |
| Sodium carbonate | 10 | 10 |
| Sodium silicate solids | 10 | 8 |

-continued

| Ingredient | Composition (wt. %) A | B |
|---|---|---|
| Sodium tripolyphosphate | 24 | 32 |
| Bentonite | 6 | 5 |
| Sodium sulfate | 25 | 24 |
| Perfume microcapsules | 0.4 | 0.6 |
| Moisture and minors | to 100 | to 100 |

EXAMPLE III

A liquid detergent composition has the following formula:

| | |
|---|---|
| Monoethanolammonium salt of alkyl benzene sulfonate | 18 |
| Condensation product of 7 moles of ethylene oxide with 1 mole of $C_{14-15}$ alkanol | 33 |
| Monoethanolamine | 2 |
| Oleic acid | 1 |
| Ethanol | 5 |
| Colloidal silica | 2 |
| Perfume microcapsules | 0.5 |
| Water and minors | to 100 |

What is claimed is:

1. A laundry detergent composition comprising: A laundry detergent composition comprising:
   (a) from 2% to 95% of a surfactant selected from the group consisting of anionic, nonionic, ampholytic and zwitterionic surfactants, and mixtures thereof; and
   (b) an effective amount of a perfuming agent comprising a perfume encapsulated in water insoluble, friable microcapsules having an average size of from about 5 to about 300 microns 2. A composition in accordance with claim 1 wherein the microcapsules have a shell wall material selected from the group consisting of polyurethane, polyolefin, polyamides, polyesters, polysaccharides, silicone resins, epoxy resins and aminoplast polymers derived from urea and an aldehyde.

3. A composition in accordance with claim 2 wherein said shell wall material is a urea-formaldehyde polymer.

4. A composition in accordance with claim 1 wherein the average size of the microcapsules is the range from about 10 to about 200 microns.

5. A composition in accordance with claim 4 wherein the microcapsules comprise from about 50% to about 85% by weight of perfume.

6. A composition in accordance with claim 1 wherein said microcapsules are present in the composition in an amount of from about 0.05% to about 5% by weight.

7. A composition in accordance with claim 6 wherein said microcapsules are present in an amount of from about 0.1% to about 1%.

8. A granular laundry detergent composition comprising:
   (a) from 10% to 25% of a surfactant selected from the group consisting of anionic, nonionic, ampholytic and zwitterionic surfactants, and mixtures thereof; and
   (b) from 10% to 60% of a detergency builder salt; and
   (c) an effective amount of a perfuming agent comprising a perfume encapsulated in water insoluble, friable microcapsules having an average size of from about 5 to about 300 microns.

9. A composition in accordance with claim 8 wherein the microcapsules have a shell was material selected from the group consisting of polyurethane, polyolefin, polyamides, polyesters, polysaccharides, silicone resins, epoxy resins and aminoplast polymers derived from urea and an aldehyde.

10. A composition in accordance with claim 9 wherein said shell wall material is a urea-formaldehyde polymer.

11. A composition in accordance with claim 10 wherein the average size of the microcapsules is the range from about 10 to about 200 microns.

12. A composition in accordance with claim 8 wherein said microcapsules are present in an amount of from about 0.1% to about 1%.

13. A liquid laundry detergent composition comprising:

(a) from 20% to 50% of a surfactant selected from the group consisting of anionic, nonionic, ampholytic and zwitterionic surfactants, and mixtures thereof; and (b) an effective amount of a perfuming agent comprising a perfume encapsulated in water insoluble, friable microcapsules having an average size of from about 5 to about 300 microns; and (c) a liquid carrier selected from the group consisting of water, $C_1$–$C_3$ alkanols and mixtures thereof.

14. A composition according to claim 13 wherein the microcapsules have a shell wall material selected from the group consisting of polyurethane, polyolefin, polyamides, polyesters, polysaccharides, silicone resins, epoxy resins and aminoplast polymers derived from urea and an aldehyde.

15. A composition according to claim 14 wherein said shell wall material is a urea-formaldehyde polymer.

16. A composition according to claim 13 wherein the average size of the microcapsules is the range from about 10 to about 200 microns.

17. A composition according to claim 13 wherein said microcapsules are present in an amount of from about 0.1% to about 1%.

18. A process of treating fabrics comprising the steps of (a) washing said fabrics in an aqueous solution of the detergent composition of claim 1 whereby at least a portion of the microcapsules become associated with the fabrics;

(b) drying said fabrics; and (c) manipulating said fabrics so as to rupture at least a portion of the microcapsules to release said perfume.

19. Fabrics when treated according to the process of claim 18.

* * * * *